US005562867A

United States Patent [19]

Tiffany, III et al.

[11] Patent Number: 5,562,867

[45] Date of Patent: Oct. 8, 1996

[54] BIODEGRADABLE TWO-CYCLE OIL COMPOSITION

[75] Inventors: George M. Tiffany, III, Princeton Junction, N.J.; Beth A. Morgan, Katy, Tex.; George C. L'Heureux, Scotch Plains, N.J.; Lewis H. Gaines, Allentown, Pa.; William H. Stover, Sarnia, Canada

[73] Assignee: Exxon Chemical Patents Inc, Linden, N.J.

[21] Appl. No.: 495,144

[22] Filed: Jun. 28, 1995

Related U.S. Application Data

[63] Continuation-in-part of Ser. No. 175,814, Dec. 30, 1993, abandoned.

[51] Int. Cl.[6] ..... C10M 105/36; C10L 1/18

[52] U.S. Cl. ..... 508/497; 044/398; 044/389; 044/459; 508/287; 508/192

[58] Field of Search ..... 252/56 S, 51.5 A

[56] References Cited

U.S. PATENT DOCUMENTS

| | | | |
|---|---|---|---|
| 2,278,445 | 4/1942 | Hull | 196/10 |
| 2,301,052 | 11/1942 | Kirn et al. | 196/10 |
| 2,318,719 | 5/1943 | Schneider et al. | 196/10 |
| 2,329,714 | 9/1943 | Grasshof | 196/10 |
| 2,345,574 | 4/1944 | Burk | 260/683.15 |
| 2,422,443 | 6/1947 | Smith | 196/78 |
| 3,087,936 | 4/1963 | Le Suer | 260/326.3 |
| 3,163,603 | 12/1964 | Le Suer | 252/33.6 |
| 3,172,892 | 3/1965 | Le Suer et al. | 260/326.5 |
| 3,219,666 | 11/1965 | Norman et al. | 260/268 |
| 3,272,736 | 9/1966 | Petro et al. | 208/348 |
| 3,306,907 | 2/1967 | McNinch et al. | 260/326.3 |
| 3,346,354 | 10/1967 | Kautsky et al. | 44/63 |
| 4,234,435 | 11/1980 | Meinhardt et al. | 252/51.5 |
| 5,221,491 | 6/1993 | Roper et al. | 252/51.5 A |

FOREIGN PATENT DOCUMENTS

| | | |
|---|---|---|
| 259809 | 3/1988 | European Pat. Off. . |
| 552554 | 7/1993 | European Pat. Off. . |

*Primary Examiner*—Ellen M. McAvoy
*Attorney, Agent, or Firm*—John J. Mahon

[57] ABSTRACT

A biodegradable two-cycle oil composition which comprises a $C_{13}$ oxo alcohol adipate in admixture with a dispersant and a lubricity agent; it is especially useful for outboard marine engines.

6 Claims, No Drawings

BIODEGRADABLE TWO-CYCLE OIL COMPOSITION

This application is a Continuation-In-Part of U.S. Ser. No. 08/175,814 filed Dec. 30, 1993, now abandoned.

BACKGROUND OF THE INVENTION

1. Field of the Invention

The invention relates to biodegradable two-cycle oil compositions comprising a tridecyl oxo alcohol adipate as a biodegradable base oil, dispersant, and a lubricity agent.

2. Description of Related Art

Two-cycle engines are lubricated by mixing the lubricant with the fuel for the engine. The mixture of fuel and lubricant passes through the crankcase of a two-cycle engine, where it lubricates the moving parts in the lower portion of the engine and then flows through intake ports into the combustion chamber. There it lubricates the cylinder zone of the engine and is burned. The combustion products are vented from the combustion chambers through exhaust ports. As a consequence, a satisfactory lubricant for a two-cycle engine must not only provide adequate lubrication for moving engine parts but also must be able to pass into the combustion chamber leaving no objectionable deposits in the intake ports; must burn cleanly to avoid fouling the combustion chamber and spark plug with undesirable deposits; control varnish and sludge formation which leads to ring sticking and in turn to failure of the sealing function of piston rings; must not result in plugging of the exhaust ports and most importantly biodegrade to natural materials upon contact with the environment.

Various methods and compositions have been suggested for obtaining dispersant or biodegradable benefits for lubricating oils.

For example, U.S. Pat. No. 5,221,491 discloses controlling gel formation in two-cycle oil with an additive comprising a reaction product of a monocarboxylic acid, a polyalkylene polyamine, and a high molecular weight acylating agent. The application further disclosed additive compositions also containing a polyolefin and a pour point depressant type flow improver.

EP-A-0552554A1 discloses automotive crankcase lubricating oil compositions which have a major proportion of a biodegradable base fluid that is a blend of (a) at least one ester of isotridecyl alcohol alcohol and a mono-, di or polycarboxylic acid and (b) at least one hydrocarbon oil which has no more than 10% on a weight basis of aromatic hydrocarbons, the rest being aliphatic. The portion of (a) in the blend is disclosed to be in the range from 25 to 55% on a weight basis. This reference does not disclose two-cycle oils because it uses several ash-forming components which are unsuitable for two-cycle oil formulations.

EP-A-0259809A2 discloses a lubricating oil composition comprising 9 to 60% by weight of mineral oil and 3 to 40% by weight of polyester. The mineral oil is disclosed to have a viscosity at 100° C. of 2 to 50 centistokes, a pour point of −5° to −30° C. and a viscosity index of not less than 80.

However, the composition of this invention provides a level of cleanliness in water cooled two-cycle engines that is surprisingly better and more environmentally friendly than that hereto obtained using commercially available composition.

SUMMARY OF THE INVENTION

This invention relates to a biodegradable two-cycle oil composition particularly suited for water-cooled outboard engines which comprises a biodegradable base oil consisting of a ditridecyl adipate prepared from a branched oxo $C_{13}$ alcohol, the ester degrading to natural products when in contact with the environment, a lubricity agent, and an oil-soluble lubricating oil dispersant. More specifically, this invention relates to a two-cycle oil composition comprising (a) a biodegradable base oil comprising from 60 to 85 vol. % of the ditridecyl adipate, (b) from 0.1 to 30 vol. % of a lubricity agent; and (c) 5–20% of at least one amide/imidazoline-containing oil soluble dispersant prepared by reacting a monocarboxylic acid acylating agent with a polyamine, and optionally a high molecular weight acylating agent.

Preferably, the oils of this invention comprise about 65–75 vol. % of the $C_{13}$ adipate, 8–15% of lubricity agent and about 8–18% of the dispersant.

DETAILED DESCRIPTION OF THE INVENTION

Biodegradable Base Oil

The biodegradable base oil used in this invention is a $C_{13}$ alcohol diadipate prepared by esterifying a $C_{13}$ oxo alcohol with adipic acid, such alcohols being branched alcohols resulting from hydroformylation of olefin in the oxo process. Straight chain $C_{13}$ alcohols are not suitable for forming esters useful in this invention.

The ditridecyl oxo alcohol adipate used in this invention as the biodegradable base oil provides multiple advantages. It is not only biodegradable but exhibits suitable detergency and lubricity, particularly in formulations designed for use as outboard marine engine oils. Another advantage of the $C_{13}$ oxo alcohol adipate formulation of this invention is that it does not adversely affect the engine sealant system.

The $C_{13}$ oxo alcohol adipate is normally present in amounts of from about 60 to 85 vol. %, based on the total volume of the two-cycle oil composition, the preferred amount being about 65 to 75 vol. %.

Lubricity Agents

Lubricity agents useful in this invention may be selected from a wide variety of oil soluble materials. Generally, they are present in an amount of from 0.1–30 volume %, preferably about 8–15 volume %. Particularly preferred is polyisobutylene having a number average molecular weight (Mn) in the range of 750 to 15,000 as measured by vapor phase osmometry or gel permeation chromatography. Other lubricity agents include polyol ethers and polyol esters, such as polyol esters of $C_5$–$C_{15}$ monocarboxylic acids particularly pentaerythritol, trimethylol propane and neopentyl glycol synlube esters of such acids, natural oils such as bright stock which is the highly viscous mineral oil fraction derived from the distillation,residues formed as a result of the preparation of lubricating oil fractions from petroleum.

Other suitable lubricity agents include phosphorus containing additives such as dihydrocarbyl hydrocarbyl phosphonates and sulfur containing lubricity agents such as sulfurized fats, sulfurized isobutylene, dialkyl polysulfides, and sulfur bridged phenols such as nonylphenol polysulfide.

Other suitable lubricity agents include fatty acids (including dimers and trimers thereof) fatty ethers, fatty esters and methoxylated fatty ethers and esters such as ethylene oxide/propylene oxide copolymers and fatty esters of these materials as well as natural materials such as vegetable oils, glycerides and the like.

Still further suitable lubricity agents include berate esters such as tricresyl borate ester condensates and phosphorus containing esters such as tricresyl phosphate and other trialkyl and triaryl phosphites and phosphates. Other lubricity agents include orthophosphate or sulfate salts of primary or secondary aliphatic amines having 4 to 24 carbon atoms, dialkyl citrates having an average of from 3½ to 13 carbon atoms in the alkyl groups, aliphatic dicarboxylic acids and esters thereof, chlorinated waxes and polyhaloaromatic compounds such as halogenated benzenes and naphthalenes.

Dispersants

Amide/imidazoline-containing ashless dispersants are preferred for use in this invention and comprise the reaction product of a monocarboxylic acid acylating agent, a polyamine and optionally a high molecular weight acylating agent. Such dispersants can also comprise imide moieties formed when the high molecular weight acylating agent is an appropriate diacid or anhydride thereof.

Throughout this specification and claims, any reference to carboxylic acids as acylating agent is intended to include the acids producing derivatives such as anhydrides, esters, acyl halides, and mixtures thereof unless otherwise specifically stated.

Polyamines

The polyamines useful as a reactant may be generally characterized by the formula:

$$H_2N(-\underset{\underset{R^1}{|}}{R}NH)_nH$$

wherein R is a $C_2$ or $C_3$ alkylene radical or mixtures thereof; $R^1$ is H or an alkyl radical of from about 1 to about 16 carbon atoms and n is an integer of one or greater.

Preferably, n is an integer less than about 6, and the alkylene group R is ethylene or propylene. Non-limiting examples of the polyamine reactants are ethylenediamine; diethylenetriamine; triethylene-tetramine; tetra-ethylene-pentamine; di-(methylethyl-ene)triamine; hexa-propylene-heptamine; tri-(ethyl-ethylene)tetramine; dipropylenetriamine; penta-(1-methylpropylene)-hexamine; hexa-(1,1-dimethylethylene)-heptamine; tri-(1,2,2-trimethylethylene)tetramine; triamine; tetra-(1,3-dimethylpropylene)-pentamine; penta-(1,2-dimethyl-1-isopropylethylene)hexamine; penta-(1-methyl-2-benzylethylene)hexamine; tetra-( 1-methyl-3-benzylpropylene)pentamine; tri-( 1-methyl-1-phenyl-3-propylpropylene)tetramine; and tetra-(1-ethyl-2-benzylethylene)pentamine. The ethylene amines are especially useful. They are discussed in some detail under the heading "Ethylene Amines" in "Encyclopedia of Chemical Technology" Kirk and Othmer, Vol. 5, pages 898–905. Interscience Publishers, New York (1950). Such compounds are prepared most conveniently by the reaction of alkylene dihalide, e.g., ethylene dichloride, with ammonia or primary amines. This reaction results in the production of somewhat complex mixtures of alkylene amines including cyclic condensation products such as piperazine and N-alkyl substituted piperazines. These mixtures find use in the compositions of this invention.

Monocarboxylic Acid Acylating Agent

The monocarboxylic acid acylating agent utilized in the preparation of the two-cycle oil composition of the present invention may preferably be any monocarboxylic acid having at least two carbon atoms and generally less than 40 carbon atoms, or aromatic monocarboxylic acids or acid-producing compounds. Generally, the number of carbon atoms in the monocarboxylic acid will range from 8 to 40, preferably from 10 to 30.

Aromatic, heterocyclic monocarboxylic acids, as well as the aliphatic monocarboxylic acids, can be used. Monocarboxylic acids containing substituent groups, are also useful herein so long as they do not contribute to engine rusting or gel formation in finished oils. However, the preferred monocarboxylic acids reactants are the aliphatic monocarboxylic acids, i.e., the branched-chain saturated or branched or straight chain unsaturated monocarboxylic acids, and the acid halides and acid anhydrides thereof. Mixtures of branched and straight chain acids can be used so long as the straight chain acid content is limited so gel or sediment will not form in finished oil. Normally, the straight chain content is limited to less than 10% of the mixture. Particularly preferred are the aliphatic monocarboxylic acid reactants having a relatively long carbon chain length, such as a carbon chain length of between about 10 carbon atoms and about 30 carbon atoms. Non-limiting examples of the monocarboxylic acid reactant; acetic acid; acetic anhydride; acetyl fluoride; acetyl chloride; propionic acid; propiolic acid; propionic acid anhydride; propionyl bromide; butyric acid anhydride; isobutyric acid; crotonic acid chloride; crotonic acid anhydride; isocrotonic acid; β-ethylacrylic acid; valeric acid; acrylic acid anhydride; allyacetic acid; hexanoic acid; hexanoyl chloride; caproic acid anhydride; sorbic acid; nitrosobutyric acid; aminovaleric acid; aminohexanoic acid; heptanoic acid; heptanoic acid anhydride; 2-ethylhexanoic acid; decanoic acid; dodecanoic acid; undecylenic acid; oleic acid; heptadecanoic acid; stearic acid; isostearic acid; linoleic acid; linolenic acid; phenylstearic acid; xylylstearic acid; α-dodecyltetradecanoic acid; behenolic acid; cerotic acid; hexahydrobenzoyl bromide; furoic acid; thiophene carboxylic acid; picolinic acid; nicotinic acid; benzoic acid; benzoic acid anhydride; benzoyliodide; benzoyl chloride; toluic acid; xylic acid; toluic acid anhydride; cinnamic acid; cinnamic acid anhydride; aminocinnamic acid; salicylic acid; hydroxytoluic acid; naphthoyl chloride; and naphthoic acid.

Isostearic acid, a commercially available mixture of methyl branched $C_{18}$ carboxylic acid containing minor amounts of other acids impurities, is the preferred monocarboxylic acid acylating agent. It is also preferred that the commercial isostearic acid have, a lactone content of less than 1.0 wt. % and that the straight chain content (GC area percent analysis) be less than 10% and preferably less than 8% of the acid. In addition, the non-$C_{18}$ acid content, comprised primarily of $C_{12}$, $C_{14}$ and $C_{16}$ acids is preferably less than 7%. A preferred isostearic acid is PRISORINE/3502 available from Unichema International of 4650 South Racine Avenue, Chicago, Ill. 60609.

High Molecular Weight Acylating Agent

The high molecular weight acylating agent, if employed, may comprise at least one aliphatic or aromatic mono or dicarboxylic acid. High molecular weight as used herein defines-the substituted acylating agent comprising number average molecular weights (Mn) which range from about 400 to 4000 and preferably from 900 to 2500, such as 950, more preferably about 400 to 1500. The polymer molecular weight distribution (Mw/Mn), wherein Mw is the weight average molecular weight, is generally less than 4.5:1, preferably less than 3:1 and more preferably 1.5:to 3:1.

The acylating agent may contain polar substituents provided that the polar substituents are not present in portions sufficiently large to significantly alter the hydrocarbon character of the acylating agent exclusive of the carboxyl groups, or cause excessive rusting when the finished additive is used in two-cycle oil. Typical suitable polar substituents include halo, (such as chloro and bromo), oxo, oxy, formyl, sulfenyl, sulfinyl, thio, nitro, etc. Such polar substituents, if present, preferably do not exceed 10% by weight of the total weight of the hydrocarbon portion of the acylating agent.

Carboxylic acylating agents used to prepare the high molecular weight acylating agents are well known in the art and have been described in detail, (see, for example, U.S. Pat. Nos. 3,087,936; 3,163,603; 34172,892; 3,219,666; 3,272,746; 3,306,907; 3,346,354; and 4,234,435). These patents disclose suitable mono- and polycarboxylic acid acylating agents which can be used as starting materials in the present invention.

As disclosed in the foregoing patents, there are several well known processes for preparing the high molecular weight acids used in this invention. Generally, the process involves the reaction of (1) an ethylenically unsaturated carboxylic acid, acid halide, or anhydride with (2) an ethylenically unsaturated hydrocarbon containing at least about 40 aliphatic carbon atoms. The ethylenically unsaturated hydrocarbon reactant can, of,course, contain polar substituents, other oil-solubilizing pendant groups, and be unsaturated within the general limitations explained hereinabove. It is these hydrocarbon reactants which frequently, but not always, provide most of the aliphatic carbon atoms present in the acyl moieties of the final products.

When preparing the high molecular weight carboxylic acid acylating agent, the carboxylic acid reactant usually corresponds to the formula $$P\,R_o\text{—}(\text{—}COOH)_n,$$

where $R_o$ can be alkyl but more frequently is characterized by the presence of at least one ethylenically unsaturated carbon-to-carbon covalent bond and n is an integer from 1 to 6 and preferably 1 or 2. The acidic reactant can also be the corresponding carboxylic acid halide, anhydride, ester, or other equivalent acylating agent and mixtures of one or more of these. Ordinarily, the total number of carbon atoms in the acidic reactant will not exceed 10 and generally will not exceed 4. Preferably the acidic reactant will have at least one ethylenic linkage in an alpha-beta position with respect to at least one carboxyl function. Exemplary acidic reactants are acrylic acid, methacrylic acid, maleic acid, maleic anhydride, succinic and succinic anhydride, fumaric acid, itaconic acid, itaconic anhydride, citraconic acid, citraconic anhydride, mesaconic acid, glutaconic acid, aconitic acid, crotonic acid, methylcrotonic acid, sorbic acid, 3-hexenoic acid, 10-decenoic acid, and the like.

As is apparent from the foregoing discussion, the high molecular weight carboxylic acid acylating agents may contain cyclic and/or aromatic groups. However, the acids are essentially aliphatic in nature and in most instances, the preferred high molecular weight acid acylating agents are aliphatically substituted succinic acids or anhydrides.

The aliphatic hydrocarbon,substituted succinic acid and anhydrides are especially preferred as acylating agents used as starting materials in the present invention. These succinic acid acylating agents are readily prepared by reacting maleic anhydride with a high molecular weight olefin or a chlorinated hydrocarbon such as a chlorinated polyolefin. The reaction involves heating the two reactants at a temperature of about 100°–300° C., preferably, 100°–200° C. The product from such a reaction is a substituted succinic anhydride where the substituent is derived from the olefin or chlorinated hydrocarbon as described in the patents cited above on page 6. The product may be hydrogenated to remove all or a portion of any ethylenically unsaturated covalent linkages by standard hydrogenation procedures, if desired. The substituted succinic anhydrides may be hydrolyzed by treatment with water or steam to the corresponding acid and either the anhydride or the acid may be converted to the corresponding acid halide or ester by reacting with phosphorus halide, phenols, or alcohols.

The ethylenically unsaturated hydrocarbon reactant and the chlorinated hydrocarbon reactant used in the preparation of the high molecular weight acylating agents are principally the high molecular weight, substantially saturated petroleum fractions and substantially saturated olefin polymers. The polymers that are derived from mono-olefins having from 2 to about 30 carbon atoms are preferred. The especially useful polymers are the polymers of 1-mono-olefins such as ethylene, propene, 1-butene, isobutene, 1-hexene, 1-octene, 1-decene, 1-dodecene, 2-methyl-1-heptene, 3-cyclohexyl-1-butene, and 2-methyl-5-propyl-1-hexene. Polymers of medial olefins, i.e., olefins in which the olefinic linkage is not at the terminal position, are also useful. These are exemplified by 2-butene, 3-pentene, and 4-octene.

The interpolymers of 1-mono-olefins such as illustrated above with each other and with other interpolymerizable olefinic substances such as aromatic olefins, cyclic olefins, and polyolefins, are also useful sources of the ethylenically unsaturated reactant. Such interpolymers include for example, those prepared by polymerizing isobutene with styrene, isobutene with butadiene, propene with isoprene, propene with isobutene, ethylene with piperylene, isobutene with p-methyl-styrene, 1-hexene with 1,3-hexadiene, 1-octene with 1-hexene, 1-heptene with 1-pentene, 3-methyl-1-butene with 1-octene, 3,3-dimethyl-1-pentene with 1-hexene, isobutene with styrene and piperylene, etc.

For reasons of hydrocarbon solubility, and stability the interpolymers contemplated for use in preparing the high molecular weight acylating agents of this invention should be substantially aliphatic and substantially saturated, that is, they should contain at least about 80% and preferably about 95%, on a weight basis, of units derived from aliphatic mono-olefins. Preferably, they will contain no more than about 5% olefinic linkages based on the total number of the carbon-to-carbon covalent linkages present.

The chlorinated hydrocarbons and ethylenically unsaturated hydrocarbons used in the preparation of the acylating agents can have molecular weight (Mn) of up to about 4000 or even higher. The preferred reactants are the above-described polyolefins and chlorinated polyolefins containing an average of at least 40 carbon atoms, preferably at least 60.

The high molecular weight acylating agent may also be prepared by halogenating a high molecular weight hydrocarbon such as the above-described olefin polymers to produce a polyhalogenated product, converting the polyhalogenated product to a polynitrile, and then hydrolyzing the polynitrile. They may be prepared by oxidation of a high molecular weight polydric alcohol with potassium permanganate, nitric acid, or a similar oxidizing agent. Another method for preparing such polycarboxylic acids involves the reaction of an olefin or a polar-substituted hydrocarbon with an unsaturated polycarboxylic acid such as 2-pentene-1,3,5-tricarboxylic acid prepared by dehydration of citric acid.

High molecular weight monocarboxylic acid acylating agent may be obtained by oxidizing a monoalcohol with potassium permanganate or by reacting a halogenated high molecular weight olefin polymer with a ketene. Another convenient method for preparing monocarboxylic acid involves the reaction of metallic sodium with an acetoacetic ester or a malonic ester of an alkanol to form a sodium derivative of the ester and the subsequent reaction of the sodium derivative with a halogenated high molecular weight hydrocarbon such as brominated wax or brominated polyisobutene.

High molecular weight monocarboxylic and polycarboxylic acid acylating agents can also be obtained by reacting chlorinated mono- and polycarboxylic acids, anhydrides, acyl halides, and the like with ethylenically unsaturated hydrocarbons or ethylenically unsaturated substituted hydrocarbons such as the polyolefins and substituted polyolefins described hereinbefore in the manner described in U.S. Pat. No. 3,340,281.

The high molecular weight monocarboxylic and polycarboxylic acid anhydrides are obtained by dehydrating the corresponding acids. Dehydration is readily accomplished by heating the acid to a temperature above about 70° C., preferably in the presence of a dehydration agent, e.g., acetic anhydride. Cyclic anhydrides are usually obtained from polycarboxylic acids having acid radicals separated by no more than three carbon atoms such as substituted succinic or glutaric acid, whereas linear anhydrides are obtained from polycarboxylic acids having the acid radicals separated by four or more carbon atoms.

The acid halides of the monocarboxylic and polycarboxylic acids can be prepared by the reaction of the acids or their anhydrides with a halogenating agent such as phosphorus tribromide, phosphorus pentachloride, or thionyl chloride.

Although it is preferred that the high molecular weight acylating agent is an aliphatic mono- or polycarboxylic acid, and more preferably a dicarboxylic acid, the substituted carboxylic acylating agent also may be prepared from aromatic mono-or polycarboxylic acid or acid-producing compound. The aromatic acids are principally mono- and dicarboxy-substituted benzene, naphthalene, anthracene, phenanthrene or like aromatic hydrocarbons. The substituted alkyl groups may contain up to about 300 carbon atoms. The aromatic acid may also contain other substituents such as hydroxy, lower alkoxy, etc. Specific examples of aromatic mono- and polycarboxylic acids and acid-producing compounds useful in preparing the high molecular weight acylating agent include benzoic acid, m-toluic acid, salicyclic acid, phthalic acid, isophthalic acid, terephthatic acid, 4-propoxy-benzoic acid, 4-methyl-benzene- 1,3-dicarboxylic acid, naphthalene-1,4 dicarboxylic acid, anthracene dicarboxylic acid, 3-dodecyl-benzene-1,4-dicarboxylic acid, 2,5-dibutylbenzene-1,4-dicarboxylic acid, etc. The anhydrides of the dicarboxylic acids also are useful as the substituted carboxylic acylating agent.

It is essential to the present invention, however, that when a high molecular weight carboxylic acylating agent is used to prepare the dispersant the combined acylating agents be selected to provide a total number of carbon atoms in the acylating agents which is sufficient to render the dispersant hydrocarbon-soluble. Generally, the sum of the carbon atoms in the two acylating agents will be at least about 40 carbon atoms and more generally will be at least about 175 carbon atoms. Accordingly, if the high molecular weight acylating agent contains a large number of carbon atoms, the monocarboxylic acid acylating agent does not need to contain a large number of carbon atoms.

Acylation of the polyalkylenepolyamine in the manner disclosed herein results in a variety of acylated polyalkylenepolyamine-containing molecular entities. As a result, the polyalkylenepolyamine molecules may not be completely acylated with the monocarboxylic acid acylating agent or both high molecular weight acylating agent and monocarboxylic acid acylating agent nor are all polyalkylene polyamine molecules acylated to the same extent. A distribution of acylated products is obtained in which the number of amine groups acylated on different amine-containing molecules ranges from zero in the extreme (no acylation) to acylation of all 1° and 2° amines (complete acylation).

Ideally, for the ashless dispersant of this invention, the distribution of acylated products is maintained as narrow as possible. Preferably, all the amine groups should not be acylated (insufficient polarity for function as a dispersant). The other extreme i.e. low acylated molecules relative to the total amine content, will result in too high polarity for satisfactory oil solubility and dispersancy and would also provide a matrix for gel formation in the finished oil.

Generally, the equivalents or molar ratio of acylating agent(s) to amine will be such that, on average, the dispersant molecules will have between 1 and 2 amine groups unreacted to provide polarity. The exact number depends on the ratio of the acylating agent to alkylenepolyamine and the ratio of the monocarboxylic acid to the optional acylating agent when the optional acylating agent is used and the specific composition of the polyalkylenepolyamine. A molar ratio of acylating agent(s) for instance, to tetraethylene pentamine can range from 1:1 to 5:1 with a ratio of 2:1 to 4.5:1 being preferred.

The ratio of the monocarboxylic acid acylating agent to high molecular weight acylating agent (when used) should be at least 2:1, preferably from 3:1, most preferably from 5:1 to 59:1 and most desirably 5:1 to 12:1 and wherein the ratio of tertiary amine to total amine in the final product is at least about 0.7:1, preferably at least 0.85:1 due to ring closure of amide/amine functionality to imidazoline.

The equivalent weight of the polyalkylene-polyamine for purposes of acylation is based on the number of primary and secondary amine groups per molecule, and the equivalent weight of these acylating agents is based on the number of carboxy groups per molecule. To illustrate, ethylene diamine has 2 equivalents per mole, and therefore, has an average equivalent weight of ½ its molecular weight and tetraethylene pentamine has 5 equivalents per mole and therefore, has an average equivalent weight of ⅕ of its molecular weight. The monocarboxylic acids have one carboxy group, and therefore the equivalent weight of the monocarboxylic acids is its molecular weight. The succinic and aromatic dicarboxylic acid acylating agents, on the other hand, have two carboxy groups per molecule, and therefore, the equivalent weight of each is ½ its molecular weight. Frequently, the equivalent weight of the polyalkylenepolyamine is determined by its nitrogen content, and the equivalent weight of acylating agents is determined by their acidity or potential acidity as measured by the neutralization or saponification equivalents.

However, many commercially available polyalkyleneamines have some tertiary nitrogen containing groups which will not acylate. For example, commercial tetraethylene pentamine contains about 10% alkyl substituted piperazine rings and probably has some tertiary amine groups formed by other branching reactions during the amine synthesis. Thus, the equivalent weight for purposes of acylation calculated from total nitrogen content will be higher than is actually the case, Equivalent weights of polyalkyleneamines can also be calculated from total amine values measured by titration with hydrochloric acid or preferably perchloric acid. However, the same limitations described above are in effect in that tertiary amine groups will titrate but not acylate.

The amide/imide/imidazoline dispersant of this invention is a complex molecule comprising oil soluble non-polar hydrocarbon containing moiety or moieties and polar unreacted amine containing moieties. For example, as discussed above for tetraethylene pentamine, the number of acylated amine groups varies in different molecules from 1 to as high as 5. The lower acylated portion of the molecules can form a matrix for gel in finished oils. This can be further exacerbated if too large a portion of the acylating groups are (1) of low molecular weight (2) are straight-chain and (3) contain undesirable pendant groups such as hydroxyl from lactone impurities in the monocarboxylic acid. Therefore, the tendency to gel formation can be reduced by increasing the average molecular weight of the combined acylating groups and increasing the ratio of acylating groups to available amine groups. However, either of the above can be detrimental if excessive. Increasing use of high molecular weight acylation agent beyond a reasonable amount would reduce the effectiveness of the dispersant in two-cycle oil. Also, increased use of both high and low molecular weight acylating agents again beyond a reasonable amount would also have a detrimental effect by disrupting the hydropholic/hydrophylic balance of the dispersant. A corollary to the above is that the preferred ranges for the ratio of high molecular weight acylating agent to low and both acylating agents to amine must be controlled to provide a dispersant which is balanced in detergency and gel avoidance.

The broad range of acylating groups to amine stated above (molar or equivalent) should leave an average of from 0% to 50 wt. % of the amine groups of the polyamine unreacted. It is preferred, however, to have from 20 to 40% of the amine groups that are titratable with hydrochloric acid before acylation still left unreacted after acylation. The most desirable amount left unreacted should be from about 30 to about 40%. As used herein, percent unreacted amine is determined by the American Oil Chemists Society (A.O.C.S.) Method Tflb-64 incorporated herein by reference. The solvents are modified slightly to facilitate seeing the end points, i.e., 80% isopropyl alcohol/water is used for tetraethylene-pentamine arid 90/10 by volume isopropylalcohol/toluene for the dispersants. The error band for this method is about +3%. Such a product would not only give acceptable gel control even with low ratios of high molecular weight acylating agent to the mono-acid but should also still have sufficient polarity (unacylated amine groups) to provide acceptable dispersant capability regardless of whether the amine is a primary, secondary or tertiary amine.

The precise composition of amide/imide/imidazoline dispersants is not known. The polar portion of the product, however, should be comprised substantially of tertiary amines in heterocyclic rings wherein the ratio of tertiary amine to total amine is about 0.7:1 (as measured by the AOCS method Tflb- 64) and more desirably, at least 0.85:1. The effectiveness of the additive in providing dispersancy is dependant in part on the ratio of the monocarboxylic acid acylating agent to the high molecular weight acylating agent and in part on the ratios of acylating agent to amine. It is also dependent on the reaction conditions under which it is formed.

The temperature and pressure of the final stage of the reaction used to prepare the amide/imidazoline or amide/imide/imidazoline dispersants of this invention is critical to maximizing tertiary amine formation, and generally, reaction temperatures ranging from 120° C. up to the decomposition temperature of any of the reactants or the product and pressures of from 0.1 to 760 mm of Hg absolute can be utilized. Preferably, however, the temperature will be above about 150° C. and more generally from about 150° to about 240° C. The pressures used range generally from about 130 to 760 mm of Hg absolute. The higher the temperature the less need there is to reduce the pressure to eliminate water and form tertiary amines as heterocycles.

The preparation of the amide/imidazoline or amide/imide/imidazoline dispersant of the invention is conducted by reaction of optionally a high molecular weight acylating agent, the alkylene polyamine and the carboxylic acylating agent or agents preferably by adding the acids or their equivalents to the amine in a "reverse addition" mode i.e. acylating agent to amine.

The reaction is preferably conducted by the addition of the acid(s) or equivalent to the amine in the "reverse addition" mode, however, the initial addition of the amine to a portion of the carboxylic acid acylating agent or a mixture of the acylating agent(s) followed by the subsequent addition of the remaining acid(s) or the separate addition of the acid(s) in any order is also acceptable.

As indicated above, the optimum raw material addition sequence is to initially add all of the polyalkylenepolyamine. The order of addition of the carboxylic acylating agent and the high molecular weight acylating agent probably has no significant effect on the final product and they may be added simultaneously. However, the "reverse addition" of acid to amine may be impractical due to mixing limitations in a batch reactor. A modification of the preferred mode comprises initially charging some acid(s) to the reactor. Generally, an amount ranging up to 50% by volume of the acid(s) is charged to cover the impellers of the reactor. Preferably, the amount charged should be just sufficient to cover the impellers. Then the amine is charged followed by the remaining acid(s). The reactor temperature at the initial charge of acids can range from 80° C. to 150° C. and preferably from 110° C. to 130° C.

The reaction time is dependent upon the size of the charge and the reaction temperature. Generally, after the charging of all the acid to the reactor the reactor temperature is increased to from 140° C. to 160° C. and allowed to soak at reflux generally from about 2 to 4 hours.

It is important that some water be present in the system (produced by acylation) during reflux to maximize the acylation reaction. If water is stripped as produced, the amine/amide groups tend to form heterocycles too soon and this reduces the number of amine groups available for acylation by the acid. Low acid conversion results in an unsatisfactory product. Allowing water to remain directs the reaction towards maximizing acylation of the available amine/amide groups of the polyamine.

After reflux, the temperature is then increased to from about 170° C. to 190° C. for a period of time, generally from 3 to 10 hours during which most of the water formed during the acylation reaction is removed and a residual total acid number of below 10 is obtained. A small amount of water remains however, which limits cyclization of amide/amine groups. In the final stage, the reactor temperature is again increased, to further remove water including water eliminated by cyclization, to from about 195° C. to about 240° C. with inert gas purge. Alternatively, vacuum stripping may be used at about 150° to about 195° C. for the time required at a reduced pressure of from about 130 to about 250 mm Hg (absolute) with an inert gas bleed. Either method is directed to achieving a tertiary amine to total amine ratio of about at least 0.7:1 or preferably 0.85:1 to 0.95:1. It is desirous to have a free water level below about 0.2 wt. %, preferably below 0.05 wt. % in the final product.

Stripping is conducted as disclosed at a temperature and pressure to cause cyclization of remaining ethyleneamine groups with adjacent amide groups. The effect of this conversion to heterocycles containing tertiary amine groups may be measured by following the increase in the tertiary amine or the reduction in primary and secondary amines. With cyclization, the total titratable amine does not change, since only one of the nitrogen atoms in the heterocyclic rings is titratable with HCl. The ring structures or tertiary amine-containing groups are still polar and provide the hydrophilic moieties of the dispersant molecule.

The ashless dispersant is normally present in the two-cycle oils of this invention in an amount of from 5–20 vol. %, preferably about 8 to 15 vol. %. These prcentages refer to the active ingredient content of the oils. As is well known in the art, such dispersants are normally produced as highly concentrated solutions in a lubricity oil fraction, e.g., about 10–95% by weight active ingredient dispersant in diluent oil carrier or solvent carrier.

It was discovered that a more stable product, one which also avoids gel formation is achieved by maximizing the conversion of the amine nitrogen to tertiary amines. The reaction process disclosed above is directed to ultimately decreasing the primary and secondary amine content and increasing the tertiary amine content of the reaction product to the ranges specified above.

Preferred for use in the two-cycle oil of this invention is a mixture of (a) a borated or non-borated polyisobutenyl succinimide dispersant having an Mn of about 950 for the polymer portion and (b) an isostearic acid-tetraethylene pentamine reaction product or a dispersant being a condensation product of these latter two materials with polyisobutenyl succinic anhydride, preferably one in which the polyisobutenyl has a Mn of 950, this mixture of dispersants comprising about 5–15% by volume of the overall composition, preferably about 8 to 15%. The weight ratio of these components is preferably about 1:1 but can vary from 1:4 to 4:1 of the (a) component to the (b) component.

Also preferred is a mixture of (a) polyisobutenyl (Mn 450) succinimide dispersant with (b) a borated or non-borated polyisobutenyl (Mn 950) succinimide dispersant. The mixture preferably comprising the two components is a weight ratio of about 1:4 to 4:1 of the (a) component to the (b) component.

A further embodiment of this invention comprises mixture of two-cycle engine fuel and the lubricating oil composition of this invention. The fuels are well known in the art and normally contain a hydrocarbon petroleum distillate, such as motor gasoline as defined by ASTM D-439-73. Such fuels can also contain non-hydrocarbonaceous materials, such as alcohols, ethers, nitro organic compounds and the like. Examples of such mixed fuels are gasoline with ethanol, diesel fuel and ether and gasoline/nitromethane mixtures.

The lubricating oil composition of this invention are used in admixture with fuels in amounts of about 20 to 250 parts by weight of fuel per 1 part by weight of lubricating oil, more typically the ratio being 30; 100 to one part of oil.

The components of the present invention can be incorporated into a lubricating oil in any convenient way. Thus, the compounds or mixtures thereof, can be added directly to the oil by dissolving the same in the desired oil at the desired level or concentrations. Alternatively, the components can be blended with a suitable oil soluble solvent such as mineral spirits and/or base oil to form a concentrate and then the concentrate may be blended with lubricating oil to obtain the final formulation.

The two-cycle oil composition of the invention can contain other additives for improving the performance of the oil in two-cycle engines in such amounts as are effective to provide their normal attendant functions. Such other additives should be substantially non-ash forming and comprise, for example, antiwear agents, anti-gel agents and other special purpose lubricating additives (including general load bearing additives), particularly phosphorous-containing antiwear agents, polyolefins (e.g., polybutene and polyisobutylene), bright stock, sulfurized olefins, molybdenum compounds, and the like; corrosion inhibitors, friction modifiers, antifoam agents, detergents, viscosity modifiers, antioxidants, such as sulfurized phenols; pour point depressants such as polyacrylates, polymethacrylates and comb polymers such as $C_8$ to $C_{18}$ alkyl esters of $C_4$ to $C_8$ mono- or dicarboxylic acids and copolymers thereof with other carboxylic acid esters such as vinyl acetates (e.g., fumarate-vinyl acetates), and other dispersants as, for example, ashless dispersants such as those prepared by reacting a hydrocarbyl substituted carboxylic acid acylating agent with an alkylene polyamine.

Solvents may be used in the lubricating oil composition of this invention to modify viscosity or compatibilize components and may generally be described as a normally liquid petroleum or synthetic hydrocarbon solvent having a boiling point not higher than about 300° C. at atmospheric pressure. The solvent should also have a flash point in the range of about 60°–120° C. Typical examples are kerosene, hydrotreated kerosene, middle distillate fuels, isoparaffinic and naphthenic aliphatic hydrocarbon solvents, dimers and higher oligomers of propylene, butene and similar olefins as well as paraffinic and aromatic hydrocarbon solvents and mixtures thereof. Such solvents may contain functional groups other than carbon and hydrogen, provided such groups do not adversely affect the performance of the two-cycle oil. Particularly preferred is a naphthenic type hydrocarbon solvent having a boiling point range of about 91.1° C.–113.9° C. (196°–327° F.) sold as "Exxsol D80" by Exxon Chemical Company. The solvent when used in the oils of this invention is present in an amount of from about 5%–20% by volume, preferably about 8%–10% by volume.

The invention is illustrated by the following examples, which are not to be considered as imitative of its scope.

EXAMPLE 1

A two-cycle oil was prepared composed of the following:

| Volume % | |
|---|---|
| 65 | Ditridecyl adipate |
| 9 | Isostearic acid/polyisobutenyl (Mn 950) succinic anhydride/tetraethylene pentamine condensation product dispersant (95% active ingredient) |
| 9 | Polyisobutenyl (Mn 950) succinimide dispersant (50% active ingredient) |
| 8 | Polyisobutylene (Mn 1300) lubricity agent |
| 1 | Isodecyl alcohol |
| 8 | "Exxsol D80"-a naphthenic hydrocarbon solvent of b.p. 91.1° C.–113.9° C. sold by Exxon Chemical Company |
| 100 | |

Biodegradability Test

The oil of this Example 1 exhibits a value of 30% in the Modified Sturm test which measures biodegradability in terms of the percentage of $CO_2$ that would be evolved if there were complete biodegradation of the material tested. This is a 28 day test using sludge innoculum; the Sturm test is reported in J. American Oil Chemists Society, 50, 159–167 (1973). A typical mineral oil for two-cycle use will have a Sturm value of 10%.

The table below reports engine test results for 40 HP (horsepower) and HP tests in accordance with the National Marine Manufacturers Association (NMMA) guidelines; the tests are part of the NMMA TC-W3 test protocol. NMMA TC-W3 approval is gained by running the 40 HP, 15 HP, 70 HP preignition test, lubricity test and 4 bench test.

Oil A is a synthetic two-cycle lubricant wherein the base stock is a trimethylol propane ester of isostearic acid.

Oil B is a synthetic two-cycle lubricant wherein the base stock is a mixture of 50% of the base stock of Oil A and 50% of the trimethylol propane ester of tall fatty acid.

Oil C is the oil of Example 1.

| | NMMA Results | | |
|---|---|---|---|
| Test-Detergency | A | B | C |
| 40 HP | Fail | Pass | Pass |
| 15 HP | — | Fail | Pass |

COMPARATIVE EXAMPLE

An oil was prepared composed of 80.4 volume % dioctyl adipate ester, polyisobutylene and 9.6 volume % dispersant. Four attempts were made to conduct the preignition engine test as reported above (NMMA, TC-W3) but in each case there was significant leakage through the crankcase due to a breakdown of the gasket sealant. The engine was a Yamaha CE-50S and the gasket sealant was "Yamabond 4" liquid gasket sealant.

What is claimed is:

1. A fuel lubricant mixture composition for a two-cycle engine consisting essentially of (a) about 20–250 parts by weight of a two-cycle engine fuel per part by weight of (b) a biodegradable two-cycle engine oil composition comprising about 60–85 volume % of a di-tridecyl adipate made from a $C_{13}$ oxo alcohol, 0.1 to 30 volume % of a lubricity agent, 5–20% by volume of a naphthenic type hydrocarbon solvent having a boiling point range of about 91.1° C.–113.9° C., and 5–20 volume % of an oil soluble lubricating oil dispersant, said oil exhibiting lubricity and detergency as required for use in water cooled outboard marine two-cycle engines, the oil having a biodegradability of at least 30% when measured in the Modified Sturm test.

2. The composition of claim 1 wherein the biodegradable ester oil comprises about 65 to 75 volume %, the lubricity agent comprises about 8 to 15 volume % and the dispersant about 8–15 volume %.

3. The composition of claims 1 or 2 wherein the dispersant comprises a mixture of a polyisobutenyl succinimide wherein the polyisobutenyl moiety has an Mn of about 950 and a polyisobutenyl succinimide dispersant where the polyisobutenyl has an Mn of about 450.

4. The composition of claim 3 wherein the lubricity agent is polyisobutylene.

5. The composition of claims 1 or 2 wherein the dispersant is a mixture of about equal portions of (a) borated or non-borated polyisobutenyl (Mn = 950) succinimide and (b) an isostearic acid/tetraethylene pentamine polyisobutenyl (Mn 950) succinic anhydride condensation product or the reaction product of isostearic acid and tetraethylene pentamine.

6. The composition of claim 5 wherein the lubricity agent is polyisobutylene.

* * * * *